US010339961B2

(12) United States Patent
Zhu et al.

(10) Patent No.: US 10,339,961 B2
(45) Date of Patent: Jul. 2, 2019

(54) VOICE ACTIVITY DETECTION METHOD AND APPARATUS

(71) Applicant: ZTE Corporation, Shenzhen (CN)

(72) Inventors: Changbao Zhu, Shenzhen (CN); Hao Yuan, Shenzhen (CN)

(73) Assignee: ZTE CORPORATION, Shenzhen (CN)

( * ) Notice: Subject to any disclaimer, the term of this patent is extended or adjusted under 35 U.S.C. 154(b) by 193 days.

(21) Appl. No.: 15/326,842

(22) PCT Filed: Oct. 24, 2014

(86) PCT No.: PCT/CN2014/089490
§ 371 (c)(1),
(2) Date: Jan. 17, 2017

(87) PCT Pub. No.: WO2015/117410
PCT Pub. Date: Aug. 13, 2015

(65) Prior Publication Data

US 2017/0206916 A1 Jul. 20, 2017

(30) Foreign Application Priority Data

Jul. 18, 2014 (CN) ..... 2014 1 0345942

(51) Int. Cl.
*G10L 25/93* (2013.01)
*G10L 25/84* (2013.01)
(Continued)

(52) U.S. Cl.
CPC ..... *G10L 25/84* (2013.01); *G10L 21/038* (2013.01); *G10L 25/21* (2013.01); *G10L 25/78* (2013.01)

(58) Field of Classification Search
None
See application file for complete search history.

(56) References Cited

U.S. PATENT DOCUMENTS 6,910,011 B1 * 6/2005 Zakarauskas ..... G10L 21/0208 704/226
9,330,672 B2 * 5/2016 Guan ..... G10L 19/02
(Continued)

FOREIGN PATENT DOCUMENTS

CN 1473321 A 2/2004
CN 102044242 A 5/2011
(Continued)

OTHER PUBLICATIONS

International Search Report for corresponding application PCT/CN2014/089490 filed Oct. 24, 2014; dated Apr. 29, 2015.
(Continued)

*Primary Examiner* — Marcus T Riley
(74) *Attorney, Agent, or Firm* — Cantor Colburn LLP

(57) ABSTRACT

Provided are a Voice Activity Detection (VAD) method and apparatus. The method includes that: at least one first class feature in a first feature category, at least one second class feature in a second feature category and at least two existing VAD judgment results are acquired, the first class feature and the second class feature are features used for VAD detection (S102); and VAD is carried out according to the first class feature, the second class feature and the at least two existing VAD judgment results, to obtain a combined VAD judgment result (S104).

20 Claims, 2 Drawing Sheets

(51) Int. Cl.

| | |
|---|---|
| ***G10L 25/78*** | (2013.01) |
| ***G10L 21/038*** | (2013.01) |
| ***G10L 25/21*** | (2013.01) |

(56) References Cited

U.S. PATENT DOCUMENTS

| | | | | |
|---|---|---|---|---|
| 9,672,841 | B2 * | 6/2017 | Jiang | G10L 25/18 |
| 9,978,398 | B2 * | 5/2018 | Zhu | G10L 25/78 |
| 2008/0120110 | A1 | 5/2008 | McDonald | |
| 2012/0215536 | A1 * | 8/2012 | Sehlstedt | G10L 25/78 704/246 |
| 2012/0232896 | A1 * | 9/2012 | Taleb | G10L 25/78 704/233 |
| 2014/0006019 | A1 | 1/2014 | Paajanen et al. | |
| 2014/0337039 | A1 * | 11/2014 | Guan | G10L 19/02 704/500 |
| 2016/0203833 | A1 * | 7/2016 | Zhu | G10L 25/78 704/233 |
| 2017/0004840 | A1 * | 1/2017 | Jiang | G10L 25/18 |
| 2017/0069331 | A1 * | 3/2017 | Sehlstedt | G10L 25/78 |
| 2017/0206916 | A1 * | 7/2017 | Zhu | G10L 25/78 |
| 2018/0158470 | A1 * | 6/2018 | Zhu | G10L 25/81 |

FOREIGN PATENT DOCUMENTS

| | | | |
|---|---|---|---|
| CN | 102687196 | A | 9/2012 |
| CN | 102741918 | A | 10/2012 |
| CN | 102971789 | A | 3/2013 |
| CN | 104424956 | A | 3/2015 |
| RU | 2009136562 | A | 4/2011 |
| WO | 2011049516 | A1 | 4/2011 |
| WO | 2011133924 | A1 | 10/2011 |
| WO | 2011140096 | A1 | 11/2011 |
| WO | 2014177084 | A1 | 11/2014 |

OTHER PUBLICATIONS

Extended European Search Report dated Jun. 27, 2017 re: Application No. 14882109.3, pp. 1-8, citing: US 2012/0232896 A1 and US 2014/0006019 A1.

RU Office Action dated Aug. 31, 2018 re: Application No. 2017103938/08(006901), pp. 1-12, citing: US 20120232896 A1, WO 2011133924 A, WO 2011049516 A1, WO 2011140096 A1 and RU 2469419 C2.

* cited by examiner

VOICE ACTIVITY DETECTION METHOD AND APPARATUS

TECHNICAL FIELD

The present disclosure relates to the field of communications, and in particular to a Voice Activity Detection (VAD) method and apparatus.

BACKGROUND

In a normal voice call, a user is sometimes talking, and sometimes listening. Under such a scenario, an inactive speech stage occurs in the call process. The total inactive speech stage of a calling party and a called party under normal circumstances occupies more than 50% of the total voice coding duration. In an inactive speech stage, there is only some background noise which usually does not have any useful information. In consideration of this fact, an active speech and a non-active speech are detected by means of a VAD algorithm in a voice signal processing procedure, and are processed using different methods respectively. Many voice coding standards currently adopted, such as an Adaptive Multiple Rate (AMR) and an Adaptive Multiple Rate-WideBand (AMR-WB), support the VAD function. In terms of efficiency, VAD of these coders cannot achieve good performance under all typical background noises. Specifically, the VAD efficiency of these coders is relatively low under an unstable noise circumstance. VAD may be wrong sometimes for a music signal, which greatly reduces the performance of a corresponding processing algorithm. In addition, the current VAD technologies have the problem of inaccurate judgment. For instance, some VAD technologies have relatively low detection accuracy when detecting several frames before a voice segment, and some VAD technologies have relatively low detection accuracy when detecting several frames after a voice segment.

An effective solution for the above problems has not been proposed yet.

SUMMARY

The embodiments of the present disclosure provide a VAD method and apparatus, which at least solve the technical problems of low detection accuracy of a conventional VAD solution.

According to one embodiment of the present disclosure, a VAD method is provided, which may include that: at least one first class feature in a first feature category, at least one second class feature in a second feature category and at least two existing VAD judgment results are acquired, in the embodiment, the first class feature and the second class feature are features used for VAD detection; and VAD is carried out according to the first class feature, the second class feature and the at least two existing VAD judgment results, to obtain a combined VAD judgment result.

In an exemplary embodiment, the first class feature in the first feature category may include at least one of: the number of continuous active frames, an average total signal-to-noise ratio (SNR) of all sub-bands and a tonality signal flag, in the embodiment, the average total SNR of all sub-bands is an average of SNR over all sub-bands for a predetermined number of frames. The second class feature in the second feature category may include at least one of: a flag of noise type, a smoothed average long-time frequency domain SNR, the number of continuous noise frames and a frequency domain SNR.

In an exemplary embodiment, the step that VAD is carried out according to the first class feature, the second class feature and the at least two existing VAD judgment results may include that: a) one VAD judgment result is selected from the at least two existing VAD judgment results as an initial value of combined VAD; b) if the flag of noise type indicates that the noise type is silence, the frequency domain SNR is greater than a preset threshold and the initial value indicates an inactive frame, a VAD flag, which is not selected as the initial value, in the at least two existing VAD judgment results is selected as the combined VAD judgment result, and otherwise, Step c) is executed, in the embodiment, the VAD flag is used for indicating that the VAD judgment result is an active frame or an inactive frame; c) if the smoothed average long-time frequency domain SNR is smaller than a preset threshold or the noise type is not silence, Step d) is executed, and otherwise, the VAD judgment result selected in Step a) is selected as the combined VAD judgment result; d) when a preset condition is met, a logical operation OR is carried out on the at least two existing VAD judgment results and the result of the logical operation OR is used as the combined VAD judgment result, and otherwise, Step e) is executed; and e) if the flag of noise type indicates that the noise type is silence, a VAD flag, which is not selected as the initial value, in the at least two existing VAD judgment results is selected as the combined VAD judgment result, and otherwise, the VAD judgment result selected in Step a) is selected as the combined VAD judgment result.

In an exemplary embodiment, the step that VAD is carried out according to the first class feature, the second class feature and the at least two existing VAD judgment results may include that: a) one VAD judgment result is selected from the at least two existing VAD judgment results as an initial value of combined VAD; b) if the flag of noise type indicates that the noise type is silence, the frequency domain SNR is greater than a preset threshold and the initial value indicates an inactive frame, a VAD flag, which is not selected as the initial value, in the at least two existing VAD judgment results is selected as the combined VAD judgment result, and otherwise, Step c) is executed, in the embodiment, the VAD flag is used for indicating that the VAD judgment result is an active frame or an inactive frame; c) if the smoothed average long-time frequency domain SNR is smaller than a preset threshold or the noise type is not silence, Step d) is executed, and otherwise, the VAD judgment result selected in Step a) is selected as the combined VAD judgment result; d) when a preset condition is met, a logical operation OR is carried out on the at least two existing VAD judgment results and the result of the logical operation OR is used as the combined VAD judgment result, and otherwise, Step e) is executed; and e) a VAD flag, which is not selected as the initial value, in the at least two existing VAD judgment results is selected as the combined VAD judgment result.

In an exemplary embodiment, the step that VAD is carried out according to the first class feature, the second class feature and the at least two existing VAD judgment results may include that: a) one VAD judgment result is selected from the at least two existing VAD judgment results as an initial value of combined VAD; and b) if the flag of noise type indicates that the noise type is silence, the smoothed average long-time frequency domain SNR is greater than a threshold and the tonality signal flag indicates a non-tonal signal, a VAD flag, which is not selected as the initial value, in the at least two existing VAD judgment results is selected as the combined VAD judgment result, in the embodiment, the VAD flag is used for indicating that the VAD judgment result is an active frame or an inactive frame.

In an exemplary embodiment, the step that VAD is carried out according to the first class feature, the second class feature and the at least two existing VAD judgment results may include that: a) one VAD judgment result is selected from the at least two existing VAD judgment results as an initial value of combined VAD; and b) if the noise type is non-silence and a preset condition is met, a logical operation OR is carried out on the at least two existing VAD judgment results, and the result of the logical operation OR is used as the combined VAD judgment result.

In an exemplary embodiment, the preset condition may include at least one of: condition 1: the average total SNR of all sub-bands is greater than a first threshold; condition 2: the average total SNR of all sub-bands is greater than a second threshold, and the number of continuous active frames is greater than a preset threshold; and condition 3: the tonality signal flag indicates a tonal signal.

In an exemplary embodiment, the step that VAD is carried out according to the first class feature, the second class feature and the at least two existing VAD judgment results may include that: if the number of continuous noise frames is greater than a first appointed threshold and the average total SNR of all sub-bands is smaller than a second appointed threshold, a logical operation AND is carried out on the at least two existing VAD judgment results, and the result of the logical operation AND is used as the combined VAD judgment result; and otherwise, one existing VAD judgment result is randomly selected from the at least two existing VAD judgment results as the combined VAD result.

In an exemplary embodiment, the smoothed average long-time frequency domain SNR and the flag of noise type may be determined by means of the following modes:

calculating average energy of long-time active frames of a current frame and average energy of long-time background noise of the current frame according to any one VAD judgment result in a combined VAD judgment result of a previous frame of the current frame or at least two existing VAD judgment results corresponding to the previous frame, average energy of long-time active frames of the previous frame within a first preset time period and average energy of long-time background noise of the previous frame;

calculating a long-time SNR of the current frame within a second time period according to the average energy of long-time background noise and average energy of long-time active frames of the current frame within the second preset time period;

calculating a smoothed average long-time frequency domain SNR of the current frame within a third preset time period according to any one VAD judgment result in the combined VAD judgment result of the current frame or at least two existing VAD judgment results corresponding to the previous frame and average frequency domain SNR of the previous frame; and determining the flag of noise type according to the long-time SNR and the smoothed average long-time frequency domain SNR.

In an exemplary embodiment, determining the flag of noise type according to the long-time SNR and the smoothed average long-time frequency domain SNR may include:

setting the flag of noise type to non-silence, and setting, when the long-time SNR is greater than a first preset threshold and the smoothed average long-time frequency domain SNR is greater than a second preset threshold, the flag of noise type to silence.

According to another embodiment of the present disclosure, a VAD apparatus is provided, which may include: an acquisition component, arranged to acquire at least one first class feature in a first feature category, at least one second class feature in a second feature category and at least two existing VAD judgment results, in the embodiment, the first class feature and the second class feature are features used for VAD detection; and a detection component, arranged to carry out, according to the first class feature, the second class feature and the at least two existing VAD judgment results, VAD to obtain a combined VAD judgment result.

In an exemplary embodiment, the acquisition component may include: a first acquisition unit, arranged to acquire the first class feature in the first feature category which includes at least one of: the number of continuous active frames, an average total signal-to-noise ratio (SNR) of all sub-bands and a tonality signal flag, in the embodiment, the average total SNR of all sub-bands is an average of SNR over all sub-bands for a predetermined number of frames; and a second acquisition unit, arranged to acquire the second class feature in the second feature category which includes at least one of: a flag of noise type, a smoothed average long-time frequency domain SNR, the number of continuous noise frames and a frequency domain SNR.

In the embodiments of the present disclosure, combined detection is carried out according to at least one first class feature in a first feature category, at least one second class feature in a second feature category and at least two existing VAD judgment results. By virtue of the above technical means, the technical problems of low detection accuracy of a VAD solution are solved, and the accuracy of VAD is improved, thereby improving the user experience.

BRIEF DESCRIPTION OF THE DRAWINGS

The drawings illustrated herein are used to provide further understanding of the embodiments of the present disclosure, and form a part of the present disclosure. The schematic embodiments and illustrations of the present disclosure are used to explain the present disclosure, and do not form improper limits to the present disclosure. In the drawings.

DETAILED DESCRIPTION OF THE EMBODIMENTS

The present disclosure will be illustrated below with reference to the drawings and in conjunction with the embodiments in detail. It is important to note that the embodiments of the present disclosure and the features in the embodiments can be combined under the condition of no conflicts.

In order to solve the problem of low detection accuracy of VAD, the following embodiments provide corresponding solutions, which will be illustrated in detail.

Figure 1:
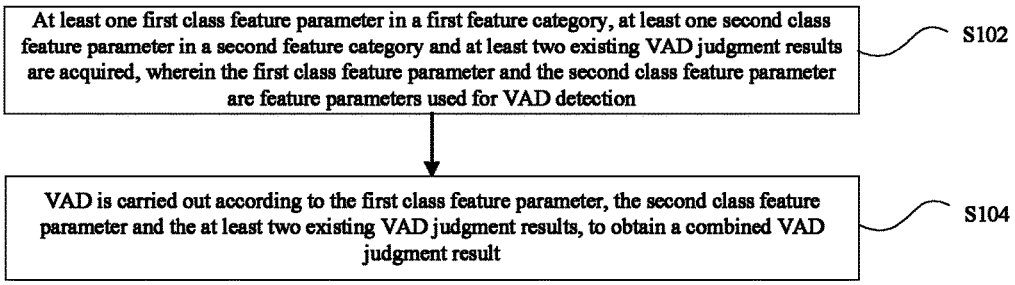
FIG. 1 is a flowchart of a VAD method according to an embodiment of the present disclosure.

FIG. 1 is a flowchart of a VAD method according to an embodiment of the present disclosure. As shown in FIG. 1, the method includes the steps S102 to S104 as follows.

Step S102: At least one first class feature in a first feature category (also called as a feature category 1), at least one second class feature in a second feature category (also called as a feature category 2) and at least two existing VAD judgment results are acquired, the first class feature and the second class feature are features used for VAD detection.

Step S104: VAD is carried out according to the first class feature, the second class feature and the at least two existing VAD judgment results, to obtain a combined VAD judgment result.

By means of all the above processing steps, combined VAD can be carried out according to at least one feature in a first feature category, at least one feature in a second feature category and at least two existing VAD judgment results, thus improving the accuracy of VAD.

In the present embodiment, the first class feature in the first feature category may include at least one of: the number of continuous active frames, an average total SNR of all sub-bands and a tonality signal flag, where the average total SNR of all sub-bands is an average of SNR over all sub-bands for a predetermined number of frames.

In the present embodiment, the second class feature in the second feature category may include at least one of: a flag of noise type, a smoothed average long-time frequency domain SNR, the number of continuous noise frames and a frequency domain SNR, the smoothed average long-time frequency domain SNR can be interpreted as: a frequency domain SNR obtained by smoothing the average of a plurality of frequency domain SNRs within a predetermined time period (long time).

There are multiple implementations for Step S104. For instance, Step S104 may be implemented by means of the modes as follows.

Judgment ending in the following several implementations is only representative of process ending of a certain implementation, and does not mean that a combined VAD judgment result is no longer modified after this process is ended.

A first implementation is executed in accordance with the following steps:

a) one VAD judgment result is selected from the at least two existing VAD judgment results as an initial value of combined VAD;

b) if the flag of noise type indicates that the noise type is silence, the frequency domain SNR is greater than a preset threshold and the initial value indicates an inactive frame, a VAD flag, which is not selected as the initial value, in the at least two existing VAD judgment results is selected as the combined VAD judgment result, and otherwise, Step c) is executed, the VAD flag is used for indicating that the VAD judgment result is an active frame or an inactive frame;

c) if the smoothed average long-time frequency domain SNR is smaller than a preset threshold or the noise type is not silence, Step d) is executed, and otherwise, the VAD judgment result selected in Step a) is selected as the combined VAD judgment result;

d) when a preset condition is met, a logical operation OR is carried out on the at least two existing VAD judgment results and the result of the logical operation OR is used as the combined VAD judgment result, and otherwise, Step e) is executed; and e) if the flag of noise type indicates that the noise type is silence, a VAD flag, which is not selected as the initial value, in the at least two existing VAD judgment results is selected as the combined VAD judgment result.

A second implementation is executed in accordance with the following steps:

a) one VAD judgment result is selected from the at least two existing VAD judgment results as an initial value of combined VAD;

b) if the flag of noise type indicates that the noise type is silence, the frequency domain SNR is greater than a preset threshold and the initial value indicates an inactive frame, a VAD flag, which is not selected as the initial value, in the at least two existing VAD judgment results is selected as the combined VAD judgment result, and otherwise, Step c) is executed, the VAD flag is used for indicating that the VAD judgment result is an active frame or an inactive frame;

c) if the smoothed average long-time frequency domain SNR is smaller than a preset threshold or the noise type is not silence, Step d) is executed, and otherwise, the VAD judgment result selected in Step a) is selected as the combined VAD judgment result;

d) when a preset condition is met, a logical operation OR is carried out on the at least two existing VAD judgment results and the result of the logical operation OR is used as the combined VAD judgment result, and otherwise, Step e) is executed; and e) a VAD flag, which is not selected as the initial value, in the at least two existing VAD judgment results is selected as the combined VAD judgment result.

A third implementation is executed in accordance with the following steps:

one VAD judgment result is selected from the at least two existing VAD judgment results as an initial value of combined VAD; and if the flag of noise type indicates that the noise type is silence, the smoothed average long-time frequency domain SNR is greater than a threshold and the tonality signal flag indicates a non-tonal signal, a VAD flag, which is not selected as the initial value, in the at least two existing VAD judgment results is selected as the combined VAD judgment result, the VAD flag is used for indicating that the VAD judgment result is an active frame or an inactive frame.

A fourth implementation is executed in accordance with the following steps:

a) one VAD judgment result is selected from the at least two existing VAD judgment results as an initial value of combined VAD; and b) if the noise type is non-silence and a preset condition is met, a logical operation OR is carried out on the at least two existing VAD judgment results, and the result of the logical operation OR is used as the combined VAD judgment result.

It is important to note that the preset condition involved in the first implementation, the second implementation and the fourth implementation may include at least one of:

condition 1: the average total SNR of all sub-bands is greater than a first threshold;

condition 2: the average total SNR of all sub-bands is greater than a second threshold, and the number of continuous active frames is greater than a preset threshold; and condition 3: the tonality signal flag indicates a tonal signal.

It is important to note that the third implementation and the fourth implementation can be used in conjunction.

A fifth implementation is executed in accordance with the following steps:

if the number of continuous noise frames is greater than a first appointed threshold and the average total SNR of all sub-bands is smaller than a second appointed threshold, a logical operation AND is carried out on the at least two existing VAD judgment results and the result of the logical operation AND is used as the combined VAD judgment result; and otherwise, one existing VAD judgment result is randomly selected from the at least two existing VAD judgment results as the combined VAD result.

It is important to note that the fifth implementation and the above four implementations can be used in conjunction.

In an exemplary embodiment of the present embodiment, the smoothed average long-time frequency domain SNR and the flag of noise type may be determined by means of the following modes:

calculating average energy of long-time active frames of a current frame and average energy of long-time background noise of the current frame according to any one VAD judgment result in a combined VAD judgment result of a previous frame of the current frame or at least two existing VAD judgment results corresponding to the previous frame, average energy of long-time active frames of the previous frames within a first preset time period and average energy of long-time background noise of the previous frames;

calculating a long-time SNR of the current frame within a second time period according to the average energy of long-time background noise and average energy of long-time active frames of the current frame within the second preset time period;

calculating a smoothed average long-time frequency domain SNR of the current frame within a third preset time period according to any one VAD judgment result in the combined VAD judgment result of the current frame or at least two existing VAD judgment results corresponding to the previous frame and average frequency domain SNR of the previous frame; and determining the flag of noise type according to the long-time SNR and the smoothed average long-time frequency domain SNR.

It is important to note that the smoothed average long-time frequency domain SNR is obtained by smoothing an average frequency domain SNR within a predetermined time period.

In an exemplary implementation, the flag of noise type may be determined based on the following manner, but is not limited to:

setting the flag of noise type to non-silence, and setting, when the long-time SNR is greater than a first preset threshold and the smoothed average long-time frequency domain SNR is greater than a second preset threshold, the flag of noise type to silence.

In an exemplary implementation, the number of continuous active frames and the number of continuous noise frames are determined by means of the following modes:

when a current frame is a non-initialized frame, calculating the number of continuous active frames and number of continuous noise frames of the current frame according to a combined VAD judgment result of a previous frame of the current frame, or when the current frame is a non-initialized frame, selecting one VAD judgment result from at least two existing VAD judgment results of the previous frame and the combined VAD judgment result of the previous frame, and calculating the number of continuous active frames and number of continuous noise frames of the current frame according to the currently selected VAD judgment result.

In an exemplary implementation process of the present embodiment, the number of continuous active frames and the number of continuous noise frames are determined by means of the following modes:

when a VAD flag for the combined VAD judgment result of the previous frame or for the currently selected VAD judgment result indicates an active frame, adding 1 to the number of continuous active frames, and otherwise, setting the number of continuous active frames to 0; and when a VAD flag for the combined VAD judgment result of the previous frame or for the currently selected VAD judgment result indicates an inactive frame, adding 1 to the number of continuous noise frames, and otherwise, setting the number of continuous noise frames to 0.

Figure 2:
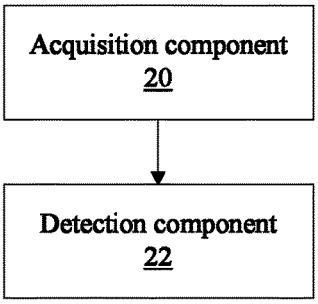
FIG. 2 is a structural diagram of a VAD apparatus according to an embodiment of the present disclosure.

In the present embodiment, a VAD apparatus is also provided. As shown in FIG. 2, the VAD apparatus includes:

an acquisition component 20, arranged to acquire at least one first class feature in a first feature category, at least one second class feature in a second feature category and at least two existing VAD judgment results, the first class feature and the second class feature are features used for VAD detection; and a detection component 22, coupled with the acquisition component 20, and arranged to carry out, according to the first class feature, the second class feature and the at least two existing VAD judgment results, VAD to obtain a combined VAD judgment result.

Figure 3:
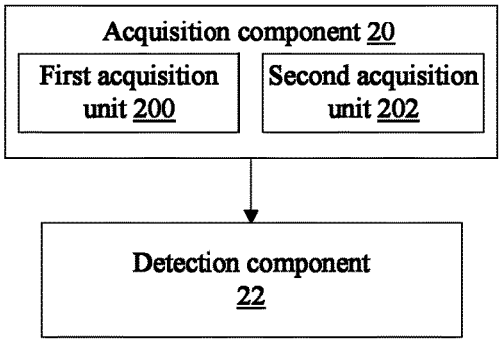
FIG. 3 is another structural diagram of a VAD apparatus according to an embodiment of the present disclosure.

In an exemplary embodiment, as shown in FIG. 3, the acquisition component 20 may also include the following processing units:

a first acquisition unit 200, arranged to acquire the first class feature in the first feature category which includes at least one of: the number of continuous active frames, an average total SNR of all sub-bands and a tonality signal flag, the average total SNR of all sub-bands is an average of SNR over all sub-bands for a predetermined number of frames; and a second acquisition unit 202, arranged to acquire the second class feature in the second feature category which includes at least one of: a flag of noise type, a smoothed average long-time frequency domain SNR, the number of continuous noise frames and a frequency domain SNR.

It is important to note that all the components involved in the present embodiment can be implemented by means of software or hardware. In an exemplary implementation, the components may be implemented by means of hardware in the following modes: the acquisition component 20 is located in a first processor, and the detection component 22 is located in a second processor; or the two components are located in, but not limited to, the same processor.

In order to better understand the above embodiment, detailed illustrations will be made below in conjunction with exemplary embodiments.

An OR operation and an AND operation involved in the following embodiments are defined as follows.

If any one VAD output flag in two VADs is an active frame, the result of the logical operation OR of the two VADs is an active frame, and when the two VADs are both inactive frames, the result of the logical operation OR is an inactive frame.

If any one VAD output flag in two VADs is an inactive frame, the result of the logical operation AND of the two VADs is an inactive frame, and when the two VADs are both active frames, the result of the logical operation AND is an active frame.

Note: if it is not specified which VAD(s) the following embodiment is/are referring to, it represents that the VAD(s) may be two existing VADs or a combined VAD or other VADs capable of achieving corresponding functions.

Judgment ending in the following embodiments is only representative of process ending of a certain implementation, and does not mean that a combined VAD judgment result is no longer modified after this process is ended.

Embodiment 1

Figure 4:
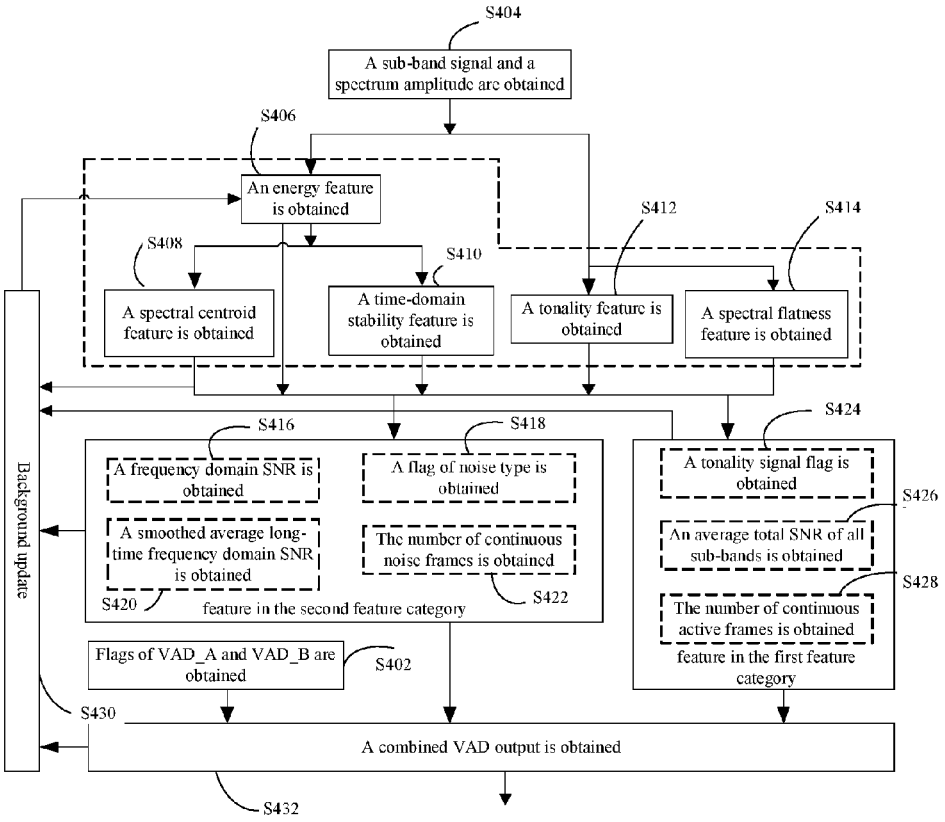
FIG. 4 is a flowchart of a VAD method according to an embodiment 1 of the present disclosure.

The present embodiment provides a VAD method. As shown in FIG. 4, the method includes the steps as follows.

Step S402: Two existing VAD output results are obtained.

Step S404: A sub-band signal and spectrum amplitude of a current frame are obtained.

The embodiments of the present disclosure are specifically illustrated with an audio stream of which a frame length is 20 ms and a sampling rate is 32 kHz. Under the conditions of other frame lengths and sampling rates, a combined VAD method provided by the embodiments of the present disclosure is also applicable.

A time domain signal of a current frame is input into a filter bank, and sub-band filtering calculation is carried out to obtain a filter bank sub-band signal.

In the present embodiment, a 40-channel filter bank is adopted. The technical solutions provided by the embodiments of the present disclosure are also applicable to filter banks with other channel amounts.

A time domain signal of a current frame is input into the 40-channel filter bank, and sub-band filtering calculation is carried out to obtain filter bank sub-band signals X[k,l] of 40 sub-bands on 16 time sampling points, $0 \le k < 40$, and $0 \le l < 16$, where k is an index of a sub-band of the filter bank, and its value represents a sub-band corresponding to a coefficient; and l is a time sampling point index of each sub-band. The implementation steps are as follows.

1: 640 latest audio signal samples are stored in a data cache.

2: Data in the data cache are shifted by 40 positions to shift 40 earliest samples out of the data cache, and 40 new samples are stored at positions 0 to 39.

Data x in the cache is multiplied by a window coefficient to obtain an array z, a calculation formula being as follows:

$$z[n]=x[n]\cdot W_{qmf}[n];0\le n<640;$$

where $W_{qmf}$ is a window coefficient of the filter bank.

80-point data u is calculated using the following pseudo-code:

```
for (n=0; n<80; n++)
{u[n]=0;
for (j=0; j<8; j++)
{
u[n]+=z[n+j·80];
  }
}
```

Arrays r and i are calculated using the following formula:

$$\begin{aligned} r[n] &= u[n]-u[79-n] \\ i[n] &= u[n]+u[79-n] \end{aligned}, \quad 0 \le n < 40$$

40 sub-band complex samples on the first time sampling point are calculated using the following formula: X[k,l]=R(k)+iI(k), $0 \le k < 40$, where R(k) and I(k) are real part and imaginary part of a coefficient of the filter bank sub-band signal X on the $l^{th}$ time sampling point, respectively. The calculation formula is as follows.

$$\begin{aligned} R(k) &= \sum_{n=0}^{39} r(n)\cos\left[\frac{\pi}{40}\left(k+\frac{1}{2}\right)n\right] \\ I(k) &= \sum_{n=0}^{39} i(n)\cos\left[\frac{\pi}{40}\left(k+\frac{1}{2}\right)n\right] \end{aligned}, \quad 0 \le k < 40.$$

3: The calculation process in Step 2 is repeated until all data of the present frame are filtered by the filter bank, and the final output result is filter bank sub-band signal X[k,l].

4: After the above calculation process is completed, the filter bank sub-band signal X[k,l] of 40 sub-bands on 16 time sampling points are obtained, where $0 \le k < 40$, and $0 \le l < 16$.

Then, time-frequency transform is carried out on the filter bank sub-band signal, and spectrum amplitudes are calculated.

The embodiments of the present disclosure can be implemented by carrying out time-frequency transform on all or part of filter bank sub-bands and calculating spectrum amplitudes. A time-frequency transform method in the embodiments of the present disclosure may be a Discrete Fourier Transform (DFT) method, a Fast Fourier Transformation (FFT) method, a Discrete Cosine Transform (DCT) method or a Discrete Sine Transform (DST) method. In the embodiments of the present disclosure, a specific implementation method is illustrated taking the use of DFT as an example. A calculation process is as follows.

16-point DFT is carried out on data of 16 time sampling points of each filter bank sub-band indexed from 0 to 9 so as to further improve the spectrum resolution. The amplitude of each frequency point is calculated to obtain spectrum amplitude $X_{DFT_AMP}$.

The calculation formula for time-frequency transform is as follows.

$$X_{DFT}[k,\ j] = \sum_{l=0}^{15} X[k,\ l]e^{-\frac{2\pi j}{16}l};$$

$$0 \le k < 10,\ 0 \le j < 16.$$

The process of calculating the amplitude of each frequency point is as follows.

Firstly, energy of an array $X_{DFT}$[k,j] on each frequency point is calculated, the calculation formula being as follows:

$$X_{DFT_POW}[k,j]=((\mathrm{Re}(X_{DFT}[k,j]))^2+(\mathrm{Im}(X_{DFT}[k,j]))^2);\quad 0\le k<10, 0\le j<16,$$

where $\mathrm{Re}(X_{DFT}[k,j])$ and $\mathrm{Im}(X_{DFT}[k,j])$ represent the real part and the imaginary part of the spectrum coefficient $X_{DFT}$[k,j], respectively.

If k is an even number, the spectrum amplitude on each frequency point is calculated using the following formula:

$$X_{DFT_AMP}[8\cdot k+j]=\sqrt{X_{\mathrm{DFT_POW}}[k,j]+X_{\mathrm{DFT_POW}}[k,15-j]};0\le k<10;0\le j<8;$$

and

If k is an odd number, the spectrum amplitude on each frequency point is calculated using the following formula:

$$X_{DFT_AMP}[8\cdot k+7-j]=\sqrt{X_{\mathrm{DFT_POW}}[k,j]+X_{\mathrm{DFT_POW}}[k,15-j]};0\le k<10;0\le j<8;$$

where $X_{DFT_AMP}$ is a spectrum amplitude subjected to time-frequency transform.

Step S406: A frame energy feature is a weighted accumulated value or directly accumulated value of all sub-band signal energies.

The frame energy feature of the current frame is calculated according to sub-band signals. Specifically, $$\text{sb_power}[k] = \sum_{l=0}^{15} ((\text{Re}(X[k, l]))^2 + (\text{Im}(X[k, l]))^2)$$

$$0 <= k < \text{band_num}.$$

Frame energy 2 can be obtained by accumulating energy sb_power in certain sub-bands.

$$\text{frame_energy2} = \sum_{n=e_sb_start}^{e_sb_end} \text{sb_power}[n];.$$

Frame energy is frame_energy=frame_energy2+fac*sb_power[0].

A plurality of SNR sub-bands can be obtained by sub-band division, and a SNR sub-band energy frame_sb_energy of the current frame can be obtained by accumulating energy in respective sub-band.

$$\text{frame_sb_energy}[i] = \sum_{j=Nregion_index[i]}^{Nregion_index[i+1]-1} \text{sb_power}[j].$$

Background noise energy, including sub-band background noise energy and background noise energy of all sub-bands, of the current frame is estimated according to a modification value of a flag of background noise, the frame energy feature of the current frame and the background noise energy of all sub-bands of previous frame. Calculation of a flag of background noise is shown in Step S430.

Step S408: The spectral centroid features are the ratio of the weighted sum to the non-weighted sum of energies of all sub-bands or partial sub-bands, or the value is obtained by applying a smooth filter to this ratio. The spectral centroid features can be obtained in the following steps.

A sub-band division for calculating the spectral centroid features is as follows.

TABLE 1

QMF sub-band division for spectral centroid features

| Spectral centroid feature number k | Start sub-band index spc__start__band | End sub-band index spc__end__band |
|---|---|---|
| 2 | 0 | 9 |
| 3 | 1 | 23 |

Two spectral centroid features, respectively the spectral centroid feature in the first interval and the spectral centroid feature in the second interval, are calculated using the subband division for calculating the spectral centroid features as shown in Table 1 and the following formula:

$$\text{sp_center}[k] = \frac{\sum_{n=spc_start_band(k)}^{spc_end_band(k)} (n+1)^* \text{sb_power}[n] + Delta1}{\sum_{n=spc_start_band(k)}^{spc_end_band(k)} \text{sb_power}[n] + Delta2};$$

$$2 \le k < 4.$$

Smooth the spectral centroid feature in the second interval sp_center[2], and obtain the smoothed spectral centroid feature in the second interval according to the following formula: sp_center[0]=fac*sp_center[0]+(1−fac)*sp_center[2].

Step S410: The time-domain stability features are the ratio of the variance of the sum of amplitudes to the expectation of the square of amplitudes, or this ratio multiplied by a factor. The time-domain stability features are computed with the energy features of the most recent N frame. Let the energy of the nth frame be frame_energy[n]. The amplitude of frame_energy[n] is computed by $\text{Amp}_{t1}[n]=\sqrt{\text{frame_energy}[n]}+\text{e_offset}$; $0 \le n < N$, where e_offset is an offset value within a range of [0,0.1].

By adding together the energy amplitudes of two adjacent frames from the current frame to the $N^{th}$ previous frame, N/2 sums of energy amplitudes are obtained as $\text{Amp}_{t2}(n)=\text{Amp}_{t1}(-2n)+\text{Amp}_{t1}(-2n-1)$; $0 \le n < 20$, where when n=0, $\text{Amp}_{t1}[n]$ represents the energy amplitude of a current frame, and when n<0, $\text{Amp}_{t1}[n]$ represents the energy amplitude of the $n^{th}$ previous frame with respect to the current frame.

Then the ratio of the variance to the average energy of the N/2 recent sums is computed to obtain the time-domain stability feature ltd_stable_rate. The calculation formula is as follows:

$$\text{ltd_stable_rate} = \sum_{n=0}^{N/2-1} \left( \text{Amp}_{t2}[n] - \frac{1}{N/2} \sum_{n=0}^{N/2-1} \text{Amp}_{t2}[n] \right)^2 \Big/ \left( \sum_{n=0}^{N/2-1} \text{Amp}_{t2}[n]^2 + \text{delta} \right)$$

Note that the value of N is different when computing different time-domain stability features.

Step S412: The tonality features are computed with the spectrum amplitudes. More specifically, they are obtained by computing the correlation coefficient of the amplitude difference of two adjacent frames, or with a further smoothing the correlation coefficient. The tonality features may be computed in the following steps.

a) Compute the amplitudes difference of two adjacent frames. If the difference is smaller than 0, set it to 0. In this way, a group of non-negative spectrum differential coefficients spec_low_dif[ ] is obtained.

b) Compute the correlation coefficient between the non-negative amplitude difference of the current frame obtained in Step a) and the non-negative amplitude difference of the previous frame to obtain the first tonality features. The calculation formula is as follows:

$$\text{f_tonality_rate} = \frac{\sum_{i=0}^{N} \text{spec_low_dif}[i]^* \text{pre_spec_low_dif}[i]}{\sqrt{\sum_{i=0}^{N} \text{spec_low_dif}[i]^{2*} \text{pre_spec_low_dif}[i]^2}},$$

where pre_spec_low_dif is the amplitude difference of the previous frame. Various tonality features can be calculated according to the following formula:

$f_tonality_rate[0]=f_tonality_rate;$ $f_tonality_rate[1]=pre_f_tonality_rate[1]*0.96f+f_tonality_rate*0.04f;$ $f_tonality_rate[2]=pre_f_tonality_rate[2]*0.90f+f_tonality_rate*0.1f;$ where pre_f_tonality_rate is the tonality features of the previous frame.

Step S414: Spectral Flatness Features are the ratio of the geometric mean to the arithmetic mean of certain spectrum amplitude, or this ratio multiplied by a factor. The spectrum amplitude spec_amp[ ] is smoothed to obtain a smoothed spectrum amplitude: smooth_spec_amp[i]=smooth_spec_amp[i]*fac+spec_amp[i]*(1−fac), 0<=i<SPEC_AMP_NUM. The smoothed spectrum amplitude is divided for three frequency regions, and the spectral flatness features are computed for these three frequency regions. Table 2 shows frequency region division for spectrum flatness.

TABLE 2 frequency region division of spectrum amplitude for spectral flatness

| Spectral flatness number k | Start sub-band index spc_amp_start[k] | End sub-band index spc_amp_end[k] |
|---|---|---|
| 0 | 5 | 19 |
| 1 | 20 | 39 |
| 2 | 40 | 64 |

The spectral flatness features are the ratio of the geometric mean geo_mean[k] to the arithmetic mean ari_mean[k] of the spectrum amplitude or the smoothed spectrum amplitude. The number of the spectrum amplitudes used to compute the spectral flatness feature SFF[k] is N[k]=spec_amp_end[k]−spec_amp_start[k]+1.

$$geo_mean[k]=(\Pi_{n=spec_amp_start[k]}^{spe_amp_end[k]} smooth_spec_amp[n])^{1/N[k]}$$

$$ari_mean[k]=(\Sigma_{n=spec_amp_start[k]}^{spec_amp_end[k]} smooth_spec_amp[n])/N[k]$$

$$SFF[k]=geo_mean[k]/ari_mean[k]$$

The spectral flatness features of the current frame are further smoothed to obtain smoothed spectral flatness features sSFM[k]=fac*sSFM[k]+(1−fac)SFF[k].

Step S416: A SNR feature of the current frame is calculated according to the estimated background noise energy of the previous frame, the frame_energy feature and the SNR sub-band energy of the current frame. Calculation steps for the frequency domain SNR are as follows.

When a flag of background noise of the previous frame is 1, sub-band background noise energy is updated, update pseudo-codes being as follows:

$$sb_bg_energy[i]=sb_bg_energy[i]*0.90f+frame_sb_energy[i]*0.1f.$$

A SNR of each sub-band is calculated according to the sub-band energy of the current frame and the estimated sub-band background noise energy of the previous frame, and the SNR of each sub-band smaller than a certain threshold is set to 0. Specifically, $$snr_sub[i]=\log 2((frame_sb_energy[i]+0.0001f)/(sb_bg_energy[i]+0.00010),$$

where snr_sub[i] smaller than −0.1 is set as zero.

An average value of SNRs of all sub-bands is a frequency domain SNR (snr). Specifically, $$snr=\frac{1}{SNR_sb_num}\sum_{i=0}^{SNR_sb_num-1} snr_sub[i].$$

Step S418: A flag of noise type is obtained according to a smooth long-time frequency domain SNR and a long-time SNR lt_snr_org.

The long-time SNR is the ratio of average energy of long-time active frames and average energy of long-time background noise. The average energy of long-time active frames and the average energy of long-time background noise are updated according to a VAD flag of a previous frame. When the VAD flag is an inactive frame, the average energy of long-time background noise is updated, and when the VAD flag is an active frame, the average energy of long-time active frames is updated. Specifically, the average energy of long-time active frames is lt_active_eng=fg_energy/fg_energy_count;

the average energy of long-time background noise is lt_inactive_eng=bg_energy/bg_energy_count, where $$fg_energy=\sum_{i=0}^{fg_energy_count-1} frame_energy[i],$$

i is an active frame index value, $$bg_energy=\sum_{j=0}^{bg_energy_count-1} frame_energy[j],$$

and j is an inactive frame index value; and the long-time SNR is lt_snr_org=log 10(lt_active_eng/lt_inactive_eng).

An initial flag of noise type is set to non-silence, and when lf_snr_smooth is greater than a set threshold THR1 and lt_snr_org is greater than a set threshold THR2, the flag of noise type is set to silence.

A calculation process of lf_snr_smooth is shown in Step S420.

The VAD used in Step S418 may be, is not limited to, one VAD in two VADs, and may also be a combined VAD.

Step S420: A calculation method for the smoothed average long-time frequency domain SNR lf_snr_smooth is as follows:

$$lf_snr_smooth=lf_snr_smooth*fac+(1-fac)*l_snr,$$

where l_snr=l_speech_snr/l_speech_snr_count−l_silence_snr/l_silence_snr_count, where l_speech_snr and l_speech_snr_count are respectively an accumulator of frequency domain SNR and a counter for the active frames, and l_silence_snr and l_silence_snr_count are respectively an accumulator of frequency domain SNR and a counter for the inactive frames. When the current frame is an initial frame, initialization is carried out as follows.

$$l_silence_snr=0.5f;$$

$$l_speech_snr=5.0f;$$

$l$_silence_$snr$_count=1; and $l$_speech_$snr$_count=1.

When the current frame is not an initial frame, the above four parameters are updated according to a VAD flag. When the VAD flag indicates that the current frame is an inactive frame, the parameters are updated in accordance with the following formula:

$l$_silence_$snr$=$l$_silence_$snr$+$snr$;

$l$_silence_$snr$_count=$l$_silence_$snr$_count+1.

When the VAD flag indicates that the current frame is an active frame, $l$_speech_$snr$=$l$_speech_$snr$+$snr$;

$l$_speech_$snr$_count=$l$_speech_$snr$_count+1.

The VAD in Step S420 may be, but is not limited to, one VAD in two VADs, and may also be a combined VAD.

Step S422: An initial value is set for the number of continuous noise frames during a first frame, the initial value being set to 0 in this embodiment. During a second frame and subsequent frames, when VAD judgment indicates an inactive frame, the number of continuous noise frames is added with 1, and otherwise, the number of continuous noise frames is set to 0.

The VAD in Step S422 may be, but is not limited to, one VAD in two VADs, and may also be a combined VAD.

Step S424: A tonality signal flag of the current frame is calculated according to the frame energy feature, tonality feature f_tonality_rate, time-domain stability feature ltd_stable_rate, spectral flatness feature sSFM and spectral centroid feature sp_center of the current frame, and it is judged whether the current frame is a tonal signal. When the current frame is judged to be a tonal signal, the current frame is considered to be a music frame. The following operations are executed.

a) Suppose current frame signal is a non-tonal signal, and a tonality frame flag music_background_frame is used to indicate whether the current frame is a tonal frame. When the value of music_background_frame is 1, it represents that the current frame is a tonal frame, and when the value of music_background_frame is 0, it represents that the current frame is non-tonal.

b) If the tonality feature f_tonality_rate[0] or its smoothed value f_tonality_rate[1] is greater than their respectively preset thresholds, Step c) is executed, and otherwise, Step d) is executed.

c) If time-domain stability feature ltd_stable_rate[5] is smaller than a set threshold, a spectral centroid feature sp_center[0] is greater than a set threshold and one of three spectral flatness features is smaller than its threshold, it is determined that the current frame is a tonal frame, the value of the tonality frame flag music_background_frame is set to 1, and Step d) is further executed.

d) A tonal level feature music_background_rate is updated according to the tonality frame flag music_background_frame, an initial value of the tonal level feature music_background_rate is set when a VAD apparatus starts to work, in the region [0, 1].

If the current tonality frame flag indicates that the current frame is a tonal frame, the tonal level feature music_background_rate is updated using the following formula:

music_background_rate=music_background_rate*$fac$+(1−$fac$).

If the current frame is not a tonal frame, the tonal level feature music_background_rate is updated using the following formula:

music_background_rate=music_background_rate*$fac$.

e) It is judged whether the current frame is a tonal signal according to the updated tonal level feature music_background_rate, and the value of the tonality signal flag music_background_f is set correspondingly.

If the tonal level feature music_background_rate is greater than a set threshold, it is determined that the current frame is a tonal signal, and otherwise, it is determined that the current frame is a non-tonal signal.

Step S426: The average total SNR of all sub-bands is an average of SNR over all sub-bands for a plurality of frames. A calculation method is as follows.

When the flag of background noise of the previous frame is 1, frame_energy of the current frame is accumulated to a background noise energy accumulator of all sub-bands t_bg_energy_sum, and the value of a background noise energy counter of all sub-bands tbg_energy_count is added with 1.

Background noise energy of all sub-bands is calculated according to the following formula: t_bg_energy=t_bg_energy_sum/tbg_energy_count.

An SNR of all sub-bands for the current frame is calculated according to the frame energy of the current frame.

$tsnr$=log 2(frame_energy+0.0001$f$)/($t_bg$_energy+0.0001$f$).

SNRs of all sub-bands for a plurality of frames are averaged to obtain an average total SNR of all sub-bands.

$$\text{snr_flux} = \frac{1}{N}\sum_{i=0}^{N-1} tsnr[i],$$

where N represents N latest frames, and tsnr[i] represents tsnr of the $i^{th}$ frame.

Step S428: An initial value is set for the number of continuous active frames during a first frame. The initial value is set to 0 in this embodiment. When the current frame is the second frame and a speech frame behind the second frame, a current number of continuous active frames is calculated according to a VAD judgment result. Specifically, When the VAD flag is 1, the number of continuous active frames is added with 1, and otherwise, the number of continuous active frames is set to 0.

The VAD in Step S428 may be, but is not limited to, one VAD in two VADs, and may also be a combined VAD.

Step S430: An initial flag of background noise of the current frame is calculated according to the frame energy feature, spectral centroid feature, time-domain stability feature, spectral flatness feature and tonality feature of the current frame, the initial flag of background noise is modified according to a VAD judgment result, tonality feature, SNR feature, tonality signal flag and time-domain stability feature of the current frame to obtain a final flag of background noise, and background noise detection is carried out according to the flag of background noise.

The flag of background noise is used for indicating whether to update background noise energy, and the value of the flag of background noise is set to 1 or 0. When the value of the flag of background noise is 1, the background noise energy is updated, and when the value of the flag of background noise is 0, the background noise energy is not updated.

Firstly, suppose the current frame is a background noise frame, and when any of the following conditions is satisfied, it can be determined that the current frame is not a noise signal.

a) The time-domain stability feature ltd_stable_rate[5] is greater than a set threshold which ranges from 0.05 to 0.30.

b) The spectral centroid feature sp_center[0] and the time-domain stability feature ltd_stable_rate[5] are greater than corresponding thresholds, respectively, the threshold corresponding to sp_center[0] ranges from 2 to 6, and the threshold corresponding to ltd_stable_rate[5] ranges from 0.001 to 0.1.

c) The tonality feature f_tonality_rate[1] and the time-domain stability feature ltd_stable_rate[5] are greater than corresponding thresholds, respectively, the threshold corresponding to f_tonality_rate[1] ranges from 0.4 to 0.6, and the threshold corresponding to ltd_stable_rate[5] ranges from 0.05 to 0.15.

d) The spectral flatness features of each sub-band or the smoothed spectral flatness features of each sub-band are smaller than correspondingly set thresholds which range from 0.70 to 0.92.

e) The frame energy frame_energy of the current frame is greater than a set threshold, the threshold ranges from 50 to 500, or the threshold is dynamically set according to long-time average energy.

f) The tonality feature f_tonality_rate is greater than a corresponding threshold.

g) The initial flag of background noise can be obtained by Step a) to Step f), and then the initial flag of background noise is modified. When the SNR feature, the tonality feature and the time-domain stability feature are smaller than corresponding thresholds, and when vad_flag and music_background_f are set to 0, the flag of background noise is updated to 1.

The VAD in Step S430 may be, but is not limited to, one VAD in two VADs, and may also be a combined VAD.

Step S432: A final combined VAD judgment result is obtained according to at least one feature in the feature category 1, at least one feature in the feature category 2 and two existing VAD judgment results.

In the following exemplary embodiment, the two existing VADs are VAD_A and VAD_B, output flags are respectively vada_flag and vadb_flag, and an output flag of a combined VAD is vad_flag. When the VAD flag is 0, it is indicative of an inactive frame, and when the VAD flag is 1, it is indicative of an active frame. A specific judgment process is as follows.

a) vadb_flag is selected as an initial value of vad_flag.

b) If the flag of noise type indicates that the noise type is silence, a frequency domain SNR is greater than a set threshold such as 0.2 and the initial value of vad_flag of the combined VAD is 0, vada_flag is selected as the combined VAD, and the judgment ends; and otherwise, Step c) is executed.

c) If the smoothed average long-time frequency domain SNR is smaller than a set threshold such as 10.5, or the noise type is not silence, Step d) is executed, and otherwise, the initial value of vad_flag selected in Step a) is selected as the combined VAD judgment result.

d) If any one of the following conditions is satisfied, a result of logical operation OR of the two VADs is used as the combined VAD, and the judgment ends; and otherwise, Step e) is executed.

Condition 1: An average total SNR of all sub-bands is greater than a first threshold such as 2.2.

Condition 2: An average total SNR of all sub-bands is greater than a second threshold such as 1.5, and the number of continuous active frames is greater than a threshold such as 40.

Condition 3: A tonality signal flag is 1.

e) If the flag of noise type indicates that the noise type is silence, vada_flag is selected as the combined VAD, and the judgment ends.

Embodiment 2

Step S432 in the embodiment 1 may also be implemented in accordance with the following modes.

A final combined VAD judgment result is obtained according to at least one feature in a feature category 1, at least one feature in a feature category 2 and two existing VAD judgment results.

In the present exemplary embodiment, the two existing VADs are VAD_A and VAD_B, output flags are respectively vada_flag and vadb_flag, and an output flag of a combined VAD is vad_flag. When the VAD flag is 0, it is indicative of an inactive frame, and when the VAD flag is 1, it is indicative of an active frame. A specific judgment process is as follows.

a) vadb_flag is selected as an initial value of vad_flag.

b) If a noise type is silence, a frequency domain SNR is greater than a set threshold such as 0.2 and the initial value of vad_flag of the combined VAD is 0, vada_flag is selected as the combined VAD, and the judgment ends; and otherwise, Step c) is executed.

c) If a smoothed average long-time frequency domain SNR is smaller than a set threshold such as 10.5 or the noise type is not silence, Step d) is executed, and otherwise, the initial value of vad_flag selected in Step a) is selected as a combined VAD judgment result.

d) If any one of the following conditions is satisfied, a result of logical operation OR of the two VADs is used as the combined VAD, and the judgment ends; and otherwise, Step e) is executed.

Condition 1: An average total SNR of all sub-bands is greater than a first threshold such as 2.0.

Condition 2: An average total SNR of all sub-bands is greater than a second threshold such as 1.5, and the number of continuous active frames is greater than a threshold such as 30.

Condition 3: A tonality signal flag is 1.

e) vada_flag is selected as the combined VAD, and the judgment ends.

Embodiment 3

Step S432 in the embodiment 1 may also be implemented in accordance with the following modes.

A final combined VAD judgment result is obtained according to at least one feature in a feature category 1, at least one feature in a feature category 2 and two existing VAD judgment results.

In the present exemplary embodiment, the two existing VADs are VAD_A and VAD_B, output flags are respectively vada_flag and vadb_flag, and an output flag of a combined VAD is vad_flag. When the VAD flag is 0, it is indicative of an inactive frame, and when the VAD flag is 1, it is indicative of an active frame. A specific judgment process is as follows.

a) vadb_flag is selected as an initial value of vad_flag.

b) If a noise type is silence, Step c) is executed, and otherwise, Step d) is executed.

c) If a smoothed average long-time frequency domain SNR is greater than 12.5 and music_background_f is 0, vad_flag is set as vada_flag, and otherwise, the initial value of vad_flag selected in Step a) is selected as a combined VAD judgment result.

d) If an average total SNR of all sub-bands is greater than 2.0, or an average total SNR of all sub-bands is greater than 1.5 and the number of continuous active frames is greater than 30, or a tonality signal flag is 1, a result of logical operation OR of the two VADs, i.e., OR (vada_flag, vadb_flag) is used as the combined VAD, and otherwise, the initial value of vad_flag selected in Step a) is selected as a combined VAD judgment result.

Embodiment 4

Step S432 in the embodiment 1 may also be implemented in accordance with the following modes.

A final combined VAD judgment result is obtained according to at least one feature in a feature category 1, at least one feature in a feature category 2 and two existing VAD judgment results.

In the following exemplary embodiment, the two existing VADs are VAD_A and VAD_B, output flags are respectively vada_flag and vadb_flag, and an output flag of a combined VAD is vad_flag. When the VAD flag is 0, it is indicative of an inactive frame, and when the VAD flag is 1, it is indicative of an active frame. A specific judgment process is as follows.

a) vadb_flag is selected as an initial value of vad_flag.

b) If a noise type is silence, Step c) is executed, and otherwise, Step d) is executed.

c) If a smoothed average long-time frequency domain SNR is greater than 12.5 and music_background_f is 0, vada_flag is set as vad_flag, and otherwise, Step e) is executed.

d) If an average total SNR of all sub-bands is greater than 1.5, or an average total SNR of all sub-bands is greater than 1.0 and the number of continuous active frames is greater than 30, or a tonality signal flag is 1, a result of logical operation OR of two VADs, i.e., OR (vada_flag, vadb_flag), is used as the combined VAD, and otherwise, Step e) is executed.

e) If the number of continuous noise frames is greater than 10 and the average total SNR of all sub-bands is smaller than 0.1, a result of AND operation on the two existing VAD output flags, i.e., AND (vada_flag, vadb_flag), is used as the combined VAD, and otherwise, vadb_flag is selected as the combined VAD.

Embodiment 5

Step S432 in the embodiment 1 may also be implemented in accordance with the following modes.

A final combined VAD judgment result is obtained according to at least one feature in a feature category 1, at least one feature in a feature category 2 and two existing VAD judgment results.

In the following exemplary embodiment, the two existing VADs are VAD_A and VAD_B, output flags are respectively vada_flag and vadb_flag, and an output flag of a combined VAD is vad_flag. When the VAD flag is 0, it is indicative of an inactive frame, and when the VAD flag is 1, it is indicative of an active frame. A specific judgment process is as follows.

a) vadb_flag is selected as an initial value of vad_flag.

b) If the noise type is silence, Step c) is executed, and otherwise, Step d) is executed.

c) If music_background_f is 0, the result of logical operation OR of the two VADs, i.e., OR (vada_flag, vadb_flag), is used as the combined VAD, and otherwise, vada_flag is selected as the combined VAD.

d) If an average total SNR of all sub-bands is greater than 2.0, or an average total SNR of all sub-bands is greater than 1.5 and the number of continuous active frames is greater than 30, or a tonality signal flag is 1, the result of logical operation OR of the two VADs, i.e., OR (vada_flag, vadb_flag), is used as the combined VAD, and otherwise, the initial value of vad_flag selected in Step a) is selected as a combined VAD judgment result.

In another embodiment, software is also provided, which is arranged to execute the technical solution described in the above embodiments and exemplary implementations.

In another embodiment, a storage medium is also provided. The software is stored in the storage medium. The storage medium includes, but is not limited to, an optical disk, a floppy disk, a hard disk, an erasable memory and the like.

Obviously, those skilled in the art shall understand that all components or all steps in the present disclosure may be implemented using a general calculation apparatus, may be centralized on a single calculation apparatus or may be distributed on a network composed of a plurality of calculation apparatuses. Optionally, they may be implemented using executable program codes of the calculation apparatuses. Thus, they may be stored in a storage apparatus and executed by the calculation apparatuses, the shown or described steps may be executed in a sequence different from this sequence under certain conditions, or they are manufactured into each integrated circuit component respectively, or a plurality of components or steps therein is manufactured into a single integrated circuit component. Thus, the present disclosure is not limited to a combination of any specific hardware and software.

The above is only the exemplary embodiments of the present disclosure, and is not used to limit the present disclosure. There may be various modifications and variations in the present disclosure for those skilled in the art. Any modifications, equivalent replacements, improvements and the like within the principle of the present disclosure shall fall within the protection scope defined by the appended claims of the present disclosure.

INDUSTRIAL APPLICABILITY

Based on the above technical solution provided by the embodiments of the present disclosure, combined detection can be carried out according to at least one first class feature in a first feature category, at least one second class feature in a second feature category and at least two existing VAD judgment results. The technical problems of low detection accuracy of a VAD solution can be solved, and the accuracy of VAD can be improved, thereby improving the user experience.

What is claimed is:

1. A Voice Activity Detection (VAD) method, comprising:

acquiring at least one first class feature in a first feature category, at least one second class feature in a second feature category and at least two existing VAD judgment results, wherein the first class feature and the second class feature are features used for VAD detection, the first class feature in the first feature category comprises at least one of: a number of continuous active frames, an average total signal-to-noise ratio (SNR) of all sub-bands and a tonality signal flag, wherein the average total SNR of all sub-bands is an average of SNR over all sub-bands for a predetermined number of frames; and the second class feature in the second feature category comprises at least one of: a flag of noise type, a smoothed average long-time frequency domain SNR, a number of continuous noise frames and a frequency domain SNR; and carrying out, according to the first class feature, the second class feature and the at least two existing VAD judgment results, VAD to obtain a combined VAD judgment result.

2. The method as claimed in claim 1, wherein carrying out VAD according to the first class feature, the second class feature and the at least two existing VAD judgment results comprises:

a) selecting one VAD judgment result from the at least two existing VAD judgment results as an initial value of combined VAD;

b) selecting a VAD flag, which is not selected as the initial value, in the at least two existing VAD judgment results as the combined VAD judgment result if the flag of noise type indicates that the noise type is silence, the frequency domain SNR is greater than a preset threshold and the initial value indicates an inactive frame, and otherwise, executing Step c), wherein the VAD flag is used for indicating that the VAD judgment result is an active frame or an inactive frame;

c) executing Step d) if the smoothed average long-time frequency domain SNR is smaller than a preset threshold or the noise type is not silence, and otherwise, selecting the VAD judgment result selected in Step a) as the combined VAD judgment result;

d) carrying out a logical operation OR on the at least two existing VAD judgment results and using a result of the logical operation OR as the combined VAD judgment result when a preset condition is met, and otherwise, executing Step e); and e) selecting a VAD flag, which is not selected as the initial value, in the at least two existing VAD judgment results as the combined VAD judgment result if the flag of noise type indicates that the noise type is silence, and otherwise, selecting the VAD judgment result selected in Step a) as the combined VAD judgment result.

3. The method as claimed in claim 1, wherein carrying out VAD according to the first class feature, the second class feature and the at least two existing VAD judgment results comprises:

a) selecting one VAD judgment result from the at least two existing VAD judgment results as an initial value of combined VAD;

b) selecting a VAD flag, which is not selected as the initial value, in the at least two existing VAD judgment results as the combined VAD judgment result if the flag of noise type indicates that the noise type is silence, the frequency domain SNR is greater than a preset threshold and the initial value indicates an inactive frame, and otherwise, executing Step c), wherein the VAD flag is used for indicating that the VAD judgment result is an active frame or an inactive frame;

c) executing Step d) if the smoothed average long-time frequency domain SNR is smaller than a preset threshold or the noise type is not silence, and otherwise, selecting the VAD judgment result selected in Step a) as the combined VAD judgment result;

d) carrying out a logical operation OR on the at least two existing VAD judgment results and using a result of the logical operation OR as the combined VAD judgment result when a preset condition is met, and otherwise, executing Step e); and e) selecting a VAD flag, which is not selected as the initial value, in the at least two existing VAD judgment results as the combined VAD judgment result.

4. The method as claimed in claim 1, wherein carrying out VAD according to the first class feature, the second class feature and the at least two existing VAD judgment results comprises:

a) selecting one VAD judgment result from the at least two existing VAD judgment results as an initial value of combined VAD; and b) selecting a VAD flag, which is not selected as the initial value, in the at least two existing VAD judgment results as the combined VAD judgment result if the flag of noise type indicates that the noise type is silence, the smoothed average long-time frequency domain SNR is greater than a threshold and the tonality signal flag indicates a non-tonal signal, wherein the VAD flag is used for indicating that the VAD judgment result is an active frame or an inactive frame.

5. The method as claimed in claim 1, wherein carrying out VAD according to the first class feature, the second class feature and the at least two existing VAD judgment results comprises:

a) selecting one VAD judgment result from the at least two existing VAD judgment results as an initial value of combined VAD; and b) carrying out a logical operation OR on the at least two existing VAD judgment results and using a result of the logical operation OR as the combined VAD judgment result if the noise type is non-silence and a preset condition is met.

6. The method as claimed in claim 2, wherein the preset condition comprises at least one of:

condition 1: the average total SNR of all sub-bands is greater than a first threshold;

condition 2: the average total SNR of all sub-bands is greater than a second threshold, and the number of continuous active frames is greater than a preset threshold; and condition 3: the tonality signal flag indicates a tonal signal.

7. The method as claimed in claim 1, wherein carrying out VAD according to the first class feature, the second class feature and the at least two existing VAD judgment results comprises:

carrying out a logical operation AND on the at least two existing VAD judgment results and using a result of the logical operation AND as the combined VAD judgment result if the number of continuous noise frames is greater than a first appointed threshold and the average total SNR of all sub-bands is smaller than a second appointed threshold; and otherwise, randomly selecting one existing VAD judgment result from the at least two existing VAD judgment results as the combined VAD judgement result.

8. The method as claimed in claim 1, wherein the smoothed average long-time frequency domain SNR and the flag of noise type are determined by means of the following modes:

calculating average energy of long-time active frames of a current frame and average energy of long-time background noise of the current frame according to any one VAD judgment result in a combined VAD judgment result of a previous frame of the current frame or at least two existing VAD judgment results corresponding to the previous frame, average energy of long-time active frames of the previous frame within a first preset time period and average energy of long-time background noise of the previous frame;

calculating a long-time SNR of the current frame within a second time period according to the average energy of long-time background noise and average energy of long-time active frames of the current frame within a second preset time period;

calculating a smoothed average long-time frequency domain SNR of the current frame within a third preset time period according to any one VAD judgment result in the combined VAD judgment result of the current frame or at least two existing VAD judgment results corresponding to the previous frame and average frequency domain SNR of the previous frame; and determining the flag of noise type according to the long-time SNR and the smoothed average long-time frequency domain SNR.

9. The method as claimed in claim 8, wherein determining the flag of noise type according to the long-time SNR and the smoothed average long-time frequency domain SNR comprises:

setting the flag of noise type to non-silence, and setting, when the long-time SNR is greater than a first preset threshold and the smoothed average long-time frequency domain SNR is greater than a second preset threshold, the flag of noise type to silence.

10. A Voice Activity Detection (VAD) apparatus, comprising a hardware processor arranged to execute the following program units:

an acquisition component, arranged to acquire at least one first class feature in a first feature category, at least one second class feature in a second feature category and at least two existing VAD judgment results, wherein the first class feature and the second class feature are features used for VAD detection; and a detection component, arranged to carry out, according to the first class feature, the second class feature and the at least two existing VAD judgment results, VAD to obtain a combined VAD judgment result;

wherein the acquisition component comprises the following program subunits:

a first acquisition unit, arranged to acquire the first class feature in the first feature category which comprises at least one of: a number of continuous active frames, an average total signal-to-noise ratio (SNR) of all sub-bands and a tonality signal flag, wherein the average total SNR of all sub-bands is an average of SNR over all sub-bands for a predetermined number of frames; and a second acquisition unit, arranged to acquire the second class feature in the second feature category which comprises at least one of: a flag of noise type, a smoothed average long-time frequency domain SNR, a number of continuous noise frames and a frequency domain SNR.

11. The apparatus as claimed in claim 10, wherein the detection component is arranged to carry out VAD according to the following manner:

a) selecting one VAD judgment result from the at least two existing VAD judgment results as an initial value of combined VAD;

b) selecting a VAD flag, which is not selected as the initial value, in the at least two existing VAD judgment results as the combined VAD judgment result if the flag of noise type indicates that the noise type is silence, the frequency domain SNR is greater than a preset threshold and the initial value indicates an inactive frame, and otherwise, executing Step c), wherein the VAD flag is used for indicating that the VAD judgment result is an active frame or an inactive frame;

c) executing Step d) if the smoothed average long-time frequency domain SNR is smaller than a preset threshold or the noise type is not silence, and otherwise, selecting the VAD judgment result selected in Step a) as the combined VAD judgment result;

d) carrying out a logical operation OR on the at least two existing VAD judgment results and using a result of the logical operation OR as the combined VAD judgment result when a preset condition is met, and otherwise, executing Step e); and e) selecting a VAD flag, which is not selected as the initial value, in the at least two existing VAD judgment results as the combined VAD judgment result if the flag of noise type indicates that the noise type is silence, and otherwise, selecting the VAD judgment result selected in Step a) as the combined VAD judgment result.

12. The apparatus as claimed in claim 10, wherein the detection component is arranged to carry out VAD according to the following manner:

a) selecting one VAD judgment result from the at least two existing VAD judgment results as an initial value of combined VAD;

b) selecting a VAD flag, which is not selected as the initial value, in the at least two existing VAD judgment results as the combined VAD judgment result if the flag of noise type indicates that the noise type is silence, the frequency domain SNR is greater than a preset threshold and the initial value indicates an inactive frame, and otherwise, executing Step c), wherein the VAD flag is used for indicating that the VAD judgment result is an active frame or an inactive frame;

c) executing Step d) if the smoothed average long-time frequency domain SNR is smaller than a preset threshold or the noise type is not silence, and otherwise, selecting the VAD judgment result selected in Step a) as the combined VAD judgment result;

d) carrying out a logical operation OR on the at least two existing VAD judgment results and using a result of the logical operation OR as the combined VAD judgment result when a preset condition is met, and otherwise, executing Step e); and e) selecting a VAD flag, which is not selected as the initial value, in the at least two existing VAD judgment results as the combined VAD judgment result.

13. The apparatus as claimed in claim 10, wherein the detection component is arranged to carry out VAD according to the following manner:

a) selecting one VAD judgment result from the at least two existing VAD judgment results as an initial value of combined VAD; and b) selecting a VAD flag, which is not selected as the initial value, in the at least two existing VAD judgment results as the combined VAD judgment result if the flag of noise type indicates that the noise type is silence, the smoothed average long-time frequency domain SNR is greater than a threshold and the tonality signal flag indicates a non-tonal signal, wherein the VAD flag is used for indicating that the VAD judgment result is an active frame or an inactive frame.

14. The apparatus as claimed in claim 10, wherein the detection component is arranged to carry out VAD according to the following manner:

a) selecting one VAD judgment result from the at least two existing VAD judgment results as an initial value of combined VAD; and b) carrying out a logical operation OR on the at least two existing VAD judgment results and using a result of the logical operation OR as the combined VAD judgment result if the noise type is non-silence and a preset condition is met.

15. The apparatus as claimed in claim 11, wherein the preset condition comprises at least one of:

condition 1: the average total SNR of all sub-bands is greater than a first threshold;

condition 2: the average total SNR of all sub-bands is greater than a second threshold, and the number of continuous active frames is greater than a preset threshold; and condition 3: the tonality signal flag indicates a tonal signal.

16. The apparatus as claimed in claim 12, wherein the preset condition comprises at least one of:

condition 1: the average total SNR of all sub-bands is greater than a first threshold;

condition 2: the average total SNR of all sub-bands is greater than a second threshold, and the number of continuous active frames is greater than a preset threshold; and condition 3: the tonality signal flag indicates a tonal signal.

17. The apparatus as claimed in claim 14, wherein the preset condition comprises at least one of:

condition 1: the average total SNR of all sub-bands is greater than a first threshold;

condition 2: the average total SNR of all sub-bands is greater than a second threshold, and the number of continuous active frames is greater than a preset threshold; and condition 3: the tonality signal flag indicates a tonal signal.

18. The apparatus as claimed in claim 10, wherein the detection component is arranged to carry out VAD according to the following manner:

carrying out a logical operation AND on the at least two existing VAD judgment results and using a result of the logical operation AND as the combined VAD judgment result if the number of continuous noise frames is greater than a first appointed threshold and the average total SNR of all sub-bands is smaller than a second appointed threshold; and otherwise, randomly selecting one existing VAD judgment result from the at least two existing VAD judgment results as the combined VAD result.

19. The method as claimed in claim 3, wherein the preset condition comprises at least one of:

condition 1: the average total SNR of all sub-bands is greater than a first threshold;

condition 2: the average total SNR of all sub-bands is greater than a second threshold, and the number of continuous active frames is greater than a preset threshold; and condition 3: the tonality signal flag indicates a tonal signal.

20. The method as claimed in claim 5, wherein the preset condition comprises at least one of:

condition 1: the average total SNR of all sub-bands is greater than a first threshold;

condition 2: the average total SNR of all sub-bands is greater than a second threshold, and the number of continuous active frames is greater than a preset threshold; and condition 3: the tonality signal flag indicates a tonal signal.

* * * * *